US007726267B2

(12) United States Patent
Plohberger

(10) Patent No.: US 7,726,267 B2
(45) Date of Patent: Jun. 1, 2010

(54) AIR GAP INSULATION WITH A CYLINDER LINER

(75) Inventor: Diethard Plohberger, Mannheim (DE)

(73) Assignee: Deutz Powersystems GmbH, Mannheim (DE)

( * ) Notice: Subject to any disclaimer, the term of this patent is extended or adjusted under 35 U.S.C. 154(b) by 296 days.

(21) Appl. No.: 12/070,241

(22) Filed: Feb. 15, 2008

(65) Prior Publication Data

US 2008/0196686 A1 Aug. 21, 2008

(30) Foreign Application Priority Data

Feb. 17, 2007 (DE) ..... 10 2007 007 977

(51) Int. Cl.
*F02F 1/10* (2006.01)

(52) U.S. Cl. ..... 123/41.84; 123/193.2

(58) Field of Classification Search ..... 123/41.84, 123/193.2

See application file for complete search history.

(56) References Cited

U.S. PATENT DOCUMENTS 2,572,392 A * 10/1951 Rosen et al. ..... 123/41.79
4,513,703 A 4/1985 Eckert
4,921,734 A 5/1990 Thorpe et al.
6,196,179 B1 * 3/2001 Frantzheld ..... 123/193.2

FOREIGN PATENT DOCUMENTS

| | | |
|---|---|---|
| DE | 1 234 095 | 5/1969 |
| DE | 1 900 922 | 9/1969 |
| DE | 27 52 633 A1 | 5/1979 |
| GB | 968342 | 9/1964 |
| WO | WO 2004/022960 A1 | 3/2004 |

* cited by examiner

*Primary Examiner*—Noah Kamen
(74) *Attorney, Agent, or Firm*—Hudak, Shunk & Farine Co. LPA

(57) ABSTRACT

A cylinder liner for an internal combustion engine, especially a gasoline motor, in which a piston can move between a lower and an upper dead center in an axial direction K, and the cylinder liner has a thrust collar, by which the cylinder liner can be fixed in a housing of the internal combustion engine, and there is provided a recess at the cylinder head end, in which there is installed an insert ring with a height $h_R$, while the thrust collar of the liner has a height $h_B$ which is between 65% and 100% or between 83% and 95% or 100% of the height $h_R$ of the insert ring.

20 Claims, 2 Drawing Sheets

AIR GAP INSULATION WITH A CYLINDER LINER

FIELD OF INVENTION

The invention concerns a cylinder liner for an internal combustion engine, especially a gasoline motor, with a crankcase, in which a crank shaft is mounted and can turn, to which is linked at least one connecting rod carrying a piston, while in the cylinder liner a piston can move between a lower and an upper dead center in an axial direction K, and the cylinder liner has a cylinder liner thrust collar, by which the cylinder liner is installed or fixed in a housing of the internal combustion engine, and there is provided a recess at the cylinder head end, in which there is installed an insert ring with a height $h_R$.

The insert ring is generally configured and arranged so that an uppermost piston ring groove let into the piston reaches as far as the insert ring when the piston is in the u.d.c. position.

BACKGROUND OF THE INVENTION

Such a cylinder liner for an internal combustion engine is known from DE 1 900 922 B. The teaching of this document deals with providing a piston and cylinder liner arrangement in which, despite the presence of an enlarged annular space between piston and cylinder liner, an oil carbon deposit which might touch the inner wall of the cylinder is avoided precisely in this space. This is accomplished in that the inner wall of the cylinder liner has a diameter-reducing section at its end near the combustion chamber. This section is produced by an insert ring set into the cylinder liner, the insert ring being preferably made from the same material as the cylinder liner and being set firmly in the recess.

In WO 2004/022960 A1, a cylinder liner with a thrust collar is described, having a recess at the cylinder head side, in which an insert ring is installed. The insert ring is made from a more thermally stable material than the cylinder liner and serves to prevent deposits on the piston. At one upper end face of the insert ring there is provided a recess inside the outer wall, so as to prevent a direct flow of heat from the insert ring to the end face portion of the cylinder liner. The insulating action is provided by an air gap so configured, or by the use of ceramics.

SUMMARY OF THE INVENTION

The basic problem of the invention is to further modify such a cylinder liner that the stability is increased in the region of the end of the liner near the combustion chamber and a sufficient insulation is assured in this region.

This problem is solved in that the thrust collar of the liner has a height $h_B$ which is between 65% and 100% or between 83% and 95% or 100% of the height $h_R$ of the insert ring. In this way, the thrust collar is configured much higher and thus more rigid than in the prior art. Thus, no other strength enhancing measures are needed, such as in the hollow throat of the cylinder liner.

While it is known that high thermal stresses occur in this region of the cylinder liner near the combustion chamber, in the past these thermal stresses have been dealt with by providing an intensive cooling precisely in this region, or by bringing the cooling as close as possible to the end face side of the cylinder liner. But such an intensive cooling makes it necessary to configure this region of the cylinder liner or its thrust collar in a filigree style, so that this region of the cylinder liner is more prone to distortion, for example, due to the gas forces in the cylinder liner. This vulnerability is intensified along the circumference of the cylinder liner by differing wall thicknesses of the surrounding crankcase or other intermediate housing. Distortion is encouraged by narrow cylinder spacings, which result from the desire for compact engines or from enlargements of the bores when further modifying existing engines. These problems are avoided by the configuration of the invention, which was made possible, first of all, by the realization that too much attention was given in the past to the thermal stresses.

In a modification of the invention, an air gap insulation is provided between the insert ring and the cylinder liner, wherein at least one air gap defined in terms of depth is provided with an overall length $l_L$, and the ratio between the height $h_R$ of the insert ring and the overall length $l_L$ is between 1.2 and 1.9 or between 1.5 and 1.7. Hence, the dissipation of heat from the insert ring to the cylinder liner is considerably decreased in this region, so that as a result this region of the cylinder liner or its thrust collar does not need to be so intensively cooled. It is no longer necessary to have separate cooling surfaces or cooling channels within the cylinder liner thrust collar and the cylinder liner or its thrust collar can be configured more massive and torsion-rigid in this region. The higher temperatures occurring in the cylinder combustion chamber due to the insulation can be at least partially intercepted by an intensification of the cooling, especially in the region of the cylinder head, and other measures, such as an adapted adjustment of the combustion, so that no disadvantages result for the exhaust emissions and fuel consumption, for example. The overall length $l_L$ of the air gap when using several separate air gaps in the form of recesses is found, as explained hereafter, from the total of the heights $h_V$ of the recesses.

In another embodiment of the invention, it can be beneficial to configure the air gap as a cavity made in the outer circumference of the insert ring or as a cavity made in the inner circumference of the recess. The circumferential cavity is produced by appropriate material relief. Of course, in the context of the invention, one can also provide combination configurations, i.e., for example, cavities arranged in the outer circumference of the insert ring and the inner circumference of the recess, although one must make sure, on the one hand, that a good insulating effect is achieved, and on the other hand that the insert ring is sufficiently stable in design and held firmly in the cylinder liner.

Moreover, it can be beneficial to arrange the cavity coaxially with the insert ring. Instead of the coaxial orientation, a decentralized arrangement is also possible, such that the depth of the cavity varies around the circumference.

It can also be beneficial to provide two, three or more cavities, being arranged one above the other in relation to the direction of motion K and with a spacing a from each other. This increases the insulating effect, yet still assures rigidity of the insert ring.

Moreover, it can be beneficial for the cavity to have a height $h_R$ in relation to the axial direction of motion K, and to provide a web in front of and behind the cavity, limiting the height $h_V$ of the cavity. Thanks to the web or webs, the insert ring in the recess is buttressed against the cylinder liner thrust collar. This has direct influence on the rigidity of the insert ring in the radial direction. Moreover, the path between the cavities is blocked off.

It can be beneficial in this case for the ratio of the height $h_V$ of the cavity to the spacing a to be between 1 and 7 or between 3 and 6 or 4.5. This ratio should be chosen depending on the desired insulating action, on the one hand, and the necessary rigidity of the insert ring, on the other.

In this regard, it can be beneficial for the insert ring to have a thickness $d_R$ and for the cavity to have a depth $t_V$, while the ratio of the thickness $d_R$ to the depth $t_V$ is between 2 and 15 or between 7 and 13. With the providing of an air gap, the heat transfer is significantly reduced. The aforementioned ratio can be chosen in consideration of the rigidity of the insert ring, on the one hand, and the insulating effect, on the other.

In a further embodiment, the insulation can be formed by an additional insulating ring between the insert ring and the cylinder liner. One will consider, for example, a ceramic material for this. The benefit of an additional ring is the additional support achieved for the insert ring in the cylinder liner thanks to omitting the cavities. The insert ring lies flush against the insulating ring and is buttressed against it. On the whole, the cylinder liner is even further stiffened.

The problem is also solved by an internal combustion engine with a cylinder liner as described above.

BRIEF DESCRIPTION OF THE DRAWINGS

Further beneficial embodiments of the invention will be found in the description of the drawings, which further describe the sample embodiments depicted in the drawing. These show:

FIG. 1 shows a cross section of the end of a cylinder liner 1 at the combustion space side, for a gasoline operated internal combustion engine, in particular. The cylinder liner 1 has a thrust collar 2, which is clamped between a cylinder head 3 and a housing 4, especially a crankcase of the engine. To seal off the cylinder liner 1 against the cylinder head 3, a cylinder head gasket 5 is provided between these parts, being arranged so that no strain is produced on the cylinder liner thrust collar 2. Between the cylinder liner 1 and the housing 4 there is arranged a water jacket 6, which is supplied with cooling water, and which extends down beneath the cylinder liner thrust collar 2.

Figure 1:
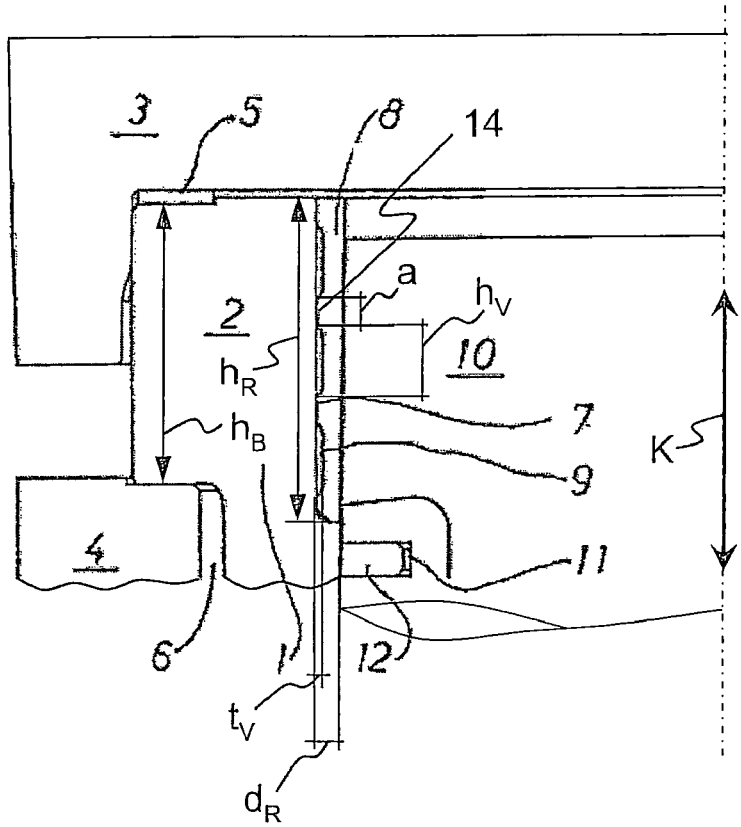
FIG. 1, a cross section of the end of a cylinder liner at the combustion space side, with air gap insulation recessed in the cylinder liner.

A recess 7 is made in the cylinder liner 2 at the side near the cylinder head 3, extending from the end of the cylinder liner 1 near the cylinder head to a region beneath the end of the thrust collar 2 at the end near the housing. In this recess 7 is set an insert ring 8, which is preferably made from the same material as the cylinder liner 1, for example, cast iron. The insert ring 8 has an air gap insulation at its outer circumference, which in the sample embodiment are recessed into the insert ring 8 in the form of three annular circumferential cavities 9. The insert ring 8 preferably has an inner diameter which is slightly smaller than that of the cylinder liner 1 in the region below the recess 7. This projection of the insert ring 8 has the effect that both the oil carbon adhering to the fire web 10.1 of a piston 10 plunging into the insert ring 8 and the oil carbon adhering to the insert ring 8 is scraped off by an axial direction K of movement of the piston 10. The depth of plunging of the piston 10 into the insert ring 8 is designed so that a piston ring 12 inserted in an upper piston ring groove 11 just fails to touch the insert ring 8 when the piston 10 is at the upper dead center (u.d.c.) position in the cylinder liner 1.

The thickness of the insert ring 8 preferably lies in the range of 10% to 15% of the overall thickness of the thrust collar 2, including the thickness of the recess 7. The rings of the insert ring 8 are around 20% larger than the height of the thrust collar 2.

Figure 2:
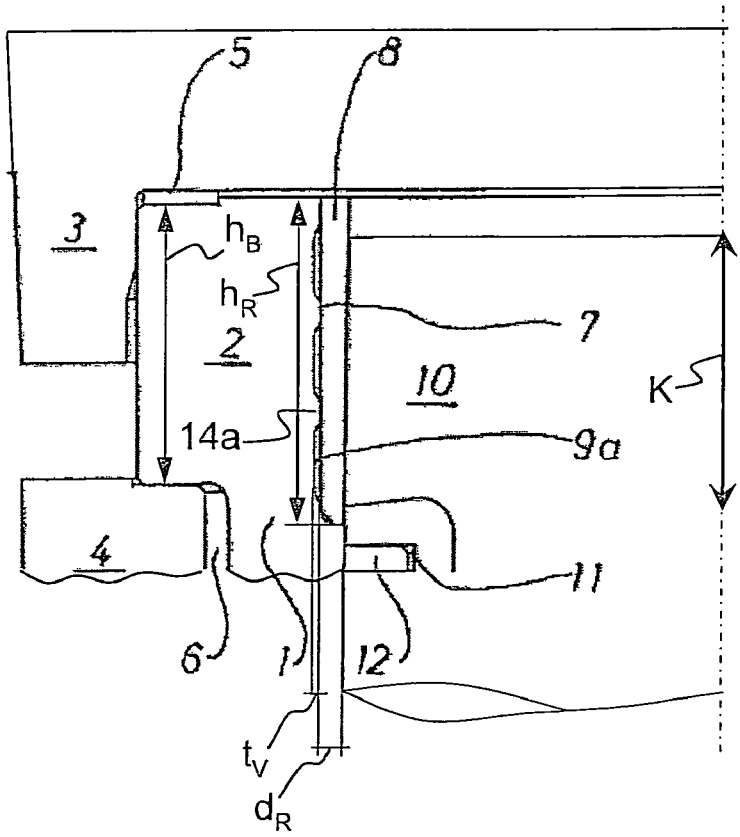
FIG. 2, a cross section of the end of a cylinder liner at the combustion space side with air gap insulation recessed in the cylinder liner with air gap insulation recessed in the insert ring.

The sample embodiment per FIG. 2 differs from that of FIG. 1 in that cavities 9*a* are made in the recess 7 of the cylinder liner 1, e.g., by lathework.

The cavities 9, 9*a* in both embodiments have a depth $t_V$, while the ratio of a thickness $d_R$ of the insert ring 8 to the depth $t_V$ is at least 5, i.e., the depth $t_V$ has up to 20% of the thickness $d_R$ of the insert ring 8.

The three cavities 9, 9*a* are arranged with a spacing a from each other and are separated by two inner webs 14, 14*a*, with the two outer webs 14, 14*a* forming the upper and lower axial closure. The ratio of a height $h_V$ of the respective cavity 9, 9*a* to the spacing a is around 4.

Figure 4:
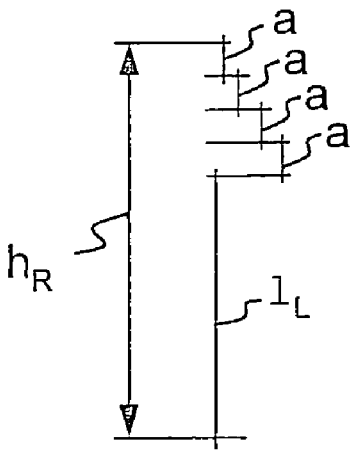
FIG. 4, a sketch to determine the overall length $l_L$ of the air gap.

The air gap formed by the cavities 9, 9*a* has an overall length $l_L$. The overall length $l_L$ results per FIG. 4 from a height $h_R$ of the insert ring 8 minus the overall length of all the webs 14, 14*a*, corresponding to four times the spacing a. The ratio of the height $h_R$ of the insert ring 8 to the overall length $l_L$ is 1.33, i.e., the overall length $l_L$ is 75% of the height $h_R$ of the insert ring 8.

Figure 3:
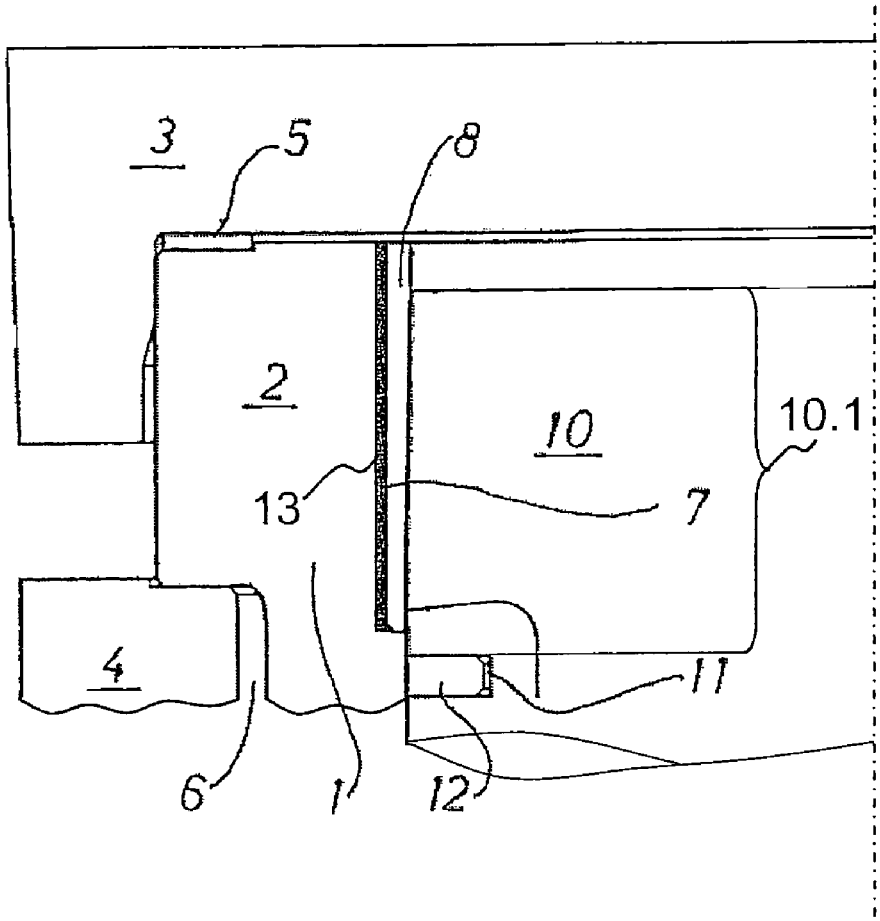
FIG. 3, a cross section per FIG. 1 with separate insulating ring.

According to sample embodiment FIG. 3, an additional insulating ring 13 is provided, being arranged between the insert ring 8 and the thrust collar 2. The insert ring 8 lies fully against the insulating ring 13. The insulating ring 13 lies fully against the cylinder liner thrust collar 2.

REFERENCE NUMBERS

1 cylinder liner
2 cylinder liner thrust collar
3 cylinder head
4 housing
5 cylinder head gasket
6 water jacket
7 recess
8 insert ring
9 cavity, air gap
9*a* cavity, air gap
10 piston
10.1 fire web
11 piston ring groove
12 piston ring
13 insulating ring
14 web
14*a* web
a spacing of cavities
$d_R$ thickness of insert ring
$t_V$ depth of cavity
$h_B$ height of cylinder liner thrust collar
$h_R$ height of insert ring
$h_V$ height of cavity
K direction of axial movement of piston
$l_L$ overall length of air gap

What is claimed is:

1. A cylinder liner for an internal combustion engine in which a piston can move between a lower and an upper dead center in an axial direction K, and the cylinder liner comprises: a thrust collar, by which the cylinder liner can be fixed in a housing of the internal combustion engine, and there is provided a recess at a cylinder head end, in which there is installed an insert ring with a height $h_R$, wherein the thrust collar of the liner has a height $h_B$ which is between 65% and 100% of the height $h_R$ of the insert ring.

2. The cylinder liner per claim 1, wherein an air gap insulation is provided between the insert ring and the cylinder liner, wherein at least one defined air gap is provided with an overall length $l_L$, and a ratio between the height $h_R$ of the insert ring and the overall length $l_L$ is between 1.1 and 1.9.

3. The cylinder liner per claim 2, wherein the air gap is configured as a cavity made in an outer circumference of the insert ring.

4. The cylinder liner per claim 3, wherein three or more cavities are provided, being arranged one above the other in relation to the direction of motion K and with a spacing a from each other.

5. The cylinder liner per claim 3, wherein the cavity has a height $h_V$ in relation to the axial direction of motion K, and a web is provided in front of and behind the cavity, limiting the height $h_V$ of the cavity.

6. The cylinder liner per claim 5, wherein the ratio of the height $h_V$ of the cavity to the spacing a is between 1 and 7.

7. The cylinder liner according to claim 6, wherein the ratio of the height $h_V$ of the cavity to the spacing a is between 3 and 6.

8. The cylinder liner per claim 2, wherein the air gap is configured as a cavity made in an inner circumference of the recess.

9. The cylinder liner according to claim 8, wherein the insert ring has a thickness $d_R$ and the cavity has a depth $t_V$, while the ratio of the thickness $d_R$ to the depth $t_V$ is between 3 and 15.

10. The cylinder liner according to claim 9, wherein the ratio of the thickness $d_R$ to the depth $t_V$ is between 7 and 13.

11. The cylinder liner per claim 8, wherein three or more cavities are provided, being arranged one above the other in relation to the direction of motion K and with a spacing a from each other.

12. The cylinder liner per claim 8, wherein the cavity has a height $h_V$ in relation to the axial direction of motion K, and a web is provided in front of and behind the cavity, limiting the height $h_V$ of the cavity.

13. The cylinder liner per claim 12, wherein the ratio of the height $h_V$ of the cavity to the spacing a is between 1 and 7.

14. The cylinder liner according to claim 8, wherein the insert ring has a thickness $d_R$ and the cavity has a depth $t_V$, while the ratio of the thickness $d_R$ to the depth $t_V$ is between 3 and 15.

15. The cylinder liner according to claim 14, wherein the ratio of the height $h_V$ of the cavity to the spacing a is between 3 and 6.

16. The cylinder liner according to claim 2, wherein the ratio between the height $h_R$ of the insert ring and the overall length $l_L$ is between 1.3 and 1.7.

17. The cylinder liner according to claim 1, wherein an additional insulating ring is provided as insulation.

18. The internal combustion engine with a cylinder liner according to claim 1.

19. The cylinder liner according to claim 1, wherein the height $h_B$ of the thrust collar of the liner is between 83% and 95% of the height $h_R$ of the insert ring.

20. The cylinder liner according to claim 19, wherein the ratio of the thickness $d_R$ to the depth $t_V$ is between 7 and 13.

* * * * *